US006065303A

United States Patent [19]

Harris

[11] Patent Number: 6,065,303

[45] Date of Patent: May 23, 2000

[54] COLD CAN OR BOTTLE COOLER DISPENSER

[76] Inventor: Randall A. Harris, 8432 Cozy Cove Hollow, Blairsville, Ga. 30512

[21] Appl. No.: 08/944,796

[22] Filed: Oct. 6, 1997

Related U.S. Application Data

[60] Provisional application No. 60/028,229, Oct. 10, 1996.

[51] Int. Cl.[7] ..... F25D 3/08

[52] U.S. Cl. ..... 62/457.5; 62/457.4

[58] Field of Search ..... 62/457.4, 457.5

[56] References Cited

U.S. PATENT DOCUMENTS

| | | | |
|---|---|---|---|
| 3,472,421 | 10/1969 | Baller | 221/196 |
| 3,605,435 | 9/1971 | Taylor | 62/457 |
| 4,491,520 | 1/1985 | Jaye | 210/232 |
| 4,555,339 | 11/1985 | Graves et al. | 210/244 |
| 4,899,904 | 2/1990 | Dooley et al. | 220/413 |
| 5,269,156 | 12/1993 | Van De Velde et al. | 62/457.4 |
| 5,295,369 | 3/1994 | Garcia | 62/389 |
| 5,395,011 | 3/1995 | Kennedy | 221/96 |
| 5,509,279 | 4/1996 | Brown et al. | 62/457.5 |

*Primary Examiner*—Henry Bennett
*Assistant Examiner*—Mark Shulman
*Attorney, Agent, or Firm*—Michael D. Fitzpatrick

[57] ABSTRACT

A cold can or bottle cooler dispenser for keeping cold and compactly transporting both homemade liquid refreshment and canned or bottled refreshments in separate compartments. A rotatable cowling having an opening which surrounds the mid-section of the cooler allows selection of the desired canned or bottled refreshment. Thus after the homemade liquid refreshment has been placed in the cooler, it need never thereafter be exposed either when loading the canned or bottled refreshments or when accessing either the canned or the homemade refreshments. Compartments are also provided for reusable substitute ice packs. A spigot on the outside of the cooler allows one to access the homemade liquid refreshment. Another embodiment of this invention can be used to retrofit or modify an existing cooler so that the modified cooler can now be used to carry both a home-made beverage and canned beverages with both beverages being kept conveniently segregated from one another.

20 Claims, 17 Drawing Sheets

COLD CAN OR BOTTLE COOLER DISPENSER

RELATED APPLICATIONS

This application claims the benefit of U.S. Provisional Application No. 60/028,229 filed on Oct. 10, 1996.

BACKGROUND

This generation is perhaps the most health conscious generation in history. Many infectious diseases have been all but eradicated by medical science. Most adults have been exposed to at least one general science course in school. Being aware of the necessity for sanitation and cleanliness, most adults wash their hands before they eat, properly cook their food, and avoid exposure of food to microorganisms. Unfortunately, when preparing to go to the beach, the typical cooler provides no sanitary way to bring both home prepared beverages such as Koolaid® or ice-tea and canned or bottled drinks to the beach. Typically the cooler is nearly filled with a home made beverage, ice cubes are added, and beverage cans or bottles are placed directly in the home made beverage. When, at the beach, one wishes to retrieve a canned or bottled drink from the cooler, one would remove the cooler's lid, reach in and retrieve a can or bottle with one's unwashed but hopefully not too dirty hand, thus possibly contaminating the home-made beverage surrounding the cans of canned drink. In addition, the mere removal of the cooler's lid exposes the homed-made beverage therein to possible contamination from dust, insects, etc. Furthermore, the removal of the cooler's lid allows warm air from the environment to enter thus shortening the length of time that the home-made beverage will stay cold. Hitherto, the only way to avoid this problem has been to bring one cooler for the home-made beverage and another cooler for canned drinks. Furthermore, the addition of ice cubes directly to the home-made beverage, results in eventual dilution of the home-made beverage.

For the foregoing reasons, there is a need for a cooler which keeps a home-made beverage separate from both the ice cubes used for cooling and from any canned drinks it was also desired to bring along. It would be advantageous if the ice cubes were also kept separate from the cans of drink, so that they would not interfere with the retrieval of a can of drink, and would not make the cans wet and slippery to the touch. In addition, there is also a need for retrofitting or modifying existing coolers with means which would ensure that a home-made beverage was kept separate from any canned drinks it was also desired to bring along.

SUMMARY

Opening

It is, therefore, the main object of the invention to provide a cooler wherein a home-made beverage, beverage cans or bottles and cooling means are all kept in separate compartments and access may be made to the beverage cans or bottles and the cooling means without exposing the home-made beverage to the air, and the home-made beverage may be accessed (via an external spigot) without exposing it to the air. In other words, once the cooler is loaded with home-made beverage, beverage cans or bottles, and cooling means such as ice-cubes or the various reusable ice substitute packs commercially available, the home-made beverage is easily accessible yet need never thereafter be exposed to the environment. Consequently, the home-made beverage is kept clean, relatively germ-free, and cold, and the beverage cans or bottles are kept cool and dry. Thus by means of my invention, there has been provided a cooler which encourages sanitary practices and reduces the spread of disease. And in a second embodiment of this invention, means is provided for retrofitting existing coolers.

Contents

The first preferred embodiment of the present invention comprises a cooler with separate compartments for home-made beverage, beverage receptacles (the phrase beverage receptacles denotes beverage cans or beverage bottles here and in the appended claims), and reusable ice substitute packs for cooling. The cooler is surrounded by a rotatable cowling having an open access door, which as it is rotated, thereby reveals the preloaded beverage cans or bottles. The home-made beverage is easily accessible via a spigot attached to the lower outside wall of the unit. The cooler is initially loaded with the reusable ice packs and beverage cans or bottles by unscrewing an outer cover, and placing beverage cans or bottles and reusable ice packs in the proper compartments. The cooler is initially loaded with home-made beverage by lifting an inner cover and pouring the home-made beverage therein. Thus during the initial loading process, the home-made beverage and the beverage cans or bottles are separately accessible, thus further guarding against contamination of the home-made beverage. The second preferred embodiment of the instant invention provides means for retrofitting existing coolers with a dispenser module to obtain the advantages of the first preferred embodiment with existing coolers.

Essentially the first preferred embodiment of my cold can or bottle cooler dispenser consists of a generally cylindrically shaped container having an upper open end and a lower closed end which has a thick bottom insulating wall. The side wall of the cooler with the bottom insulating wall defines an interior region. Within this interior region is a hollow structure for holding a beverage. This hollow structure is open at the top and has the same height as the side wall. The lower end of the hollow structure is attached to the bottom wall. The hollow structure is centrally disposed within the interior region of the container and is aligned with the central axis of the container. The portion of the interior region between the container and the hollow structure defines a space. Within this space is a plurality of partitions which extend from the inner surface of the side wall to the outer surface of the hollow structure. These partitions are attached to the bottom wall and have substantially the same height as the side wall. These partitions divide the space into an alternating series of compartments for holding cans or bottles, and compartments for holding reusable ice packs. Each of the compartments has an upper open end and is bounded by a section of the side wall. Each of the compartments for holding cans or bottles is of sufficient size to accommodate at least one beverage can or bottle. Thus each of the compartments for holding cans or bottles has an upper open end for receiving beverage cans or bottles and has an opening in the section of the side wall near its lower end for dispensing beverage cans or bottles.

A rotatable cowling having a doorway provides means for covering and for accessing the openings in the side wall, thus providing access to the beverage cans or bottles held therein. A lid covers the upper open end of the container. In the preferred embodiment an inner lid of the push down type covers just the hollow structure, and an outer lid of the unscrew type covers the compartments for holding beverage cans or bottles and the reusable ice packs. Finally, a conduit leads from the lower end of the hollow structure to near the lower end of the container. This conduit terminates in a spigot having an open position and a closed position such that when the spigot is in its open position, any liquid contents within the hollow structure is free to flow through the conduit and out of the spigot.

In a lesser preferred embodiment, there is just one lid covering the home-made beverage compartment and the compartments for beverage cans or bottles and the reusable ice-packs.

The second preferred embodiment which is used to retrofit existing coolers (which provides all the features of the first preferred embodiment except for isolation of ice from the home-made soft drinks) consists of a tube-like can dispenser for holding canned drinks. A flange gasket is placed over the protruding walls of the flange of the can dispenser and pressed flush against the flange proper. An opening is then cut in the side of the cooler just large enough for the protruding walls of the flange of the dispenser to fit through, and smaller holes are drilled through the cooler shell for flange screws to be inserted. Then the can dispenser is placed within the cooler cavity. The flange of the dispenser is pressed against the cut-out opening causing it to project through the cooler wall. The exterior flange (which has a clear door for viewing cans placed in the dispenser) is placed so that its screw holes are aligned with the screw holes in the cooler wall. The screws are then inserted into the screw holes of the exterior flange, and are successively pushed through the screw holes in the exterior walls of the cooler and the flange gasket, and then the screws are screwed tightly into the flange.

The above features are objects of this invention. Yet further objects are as follows:

An object of the instant invention is to provide a cooler that is simple and easy to use.

A further object is to provide a cooler that is economical in cost to manufacture.

These and other objects, features, aspects, and advantages of the present invention will become better understood with regard to the following description, appended claims, and accompanying drawings and will be otherwise apparent to those skilled in the art.

For the purpose of illustration of this invention, two preferred embodiment are shown in the accompanying drawings, one a cold can or bottle cooler dispenser, and the other a can dispenser for retrofitting existing coolers. It is to be understood that this is for the purpose of example only and that the invention is not limited thereto.

DESCRIPTION

Overview

Figure 1:
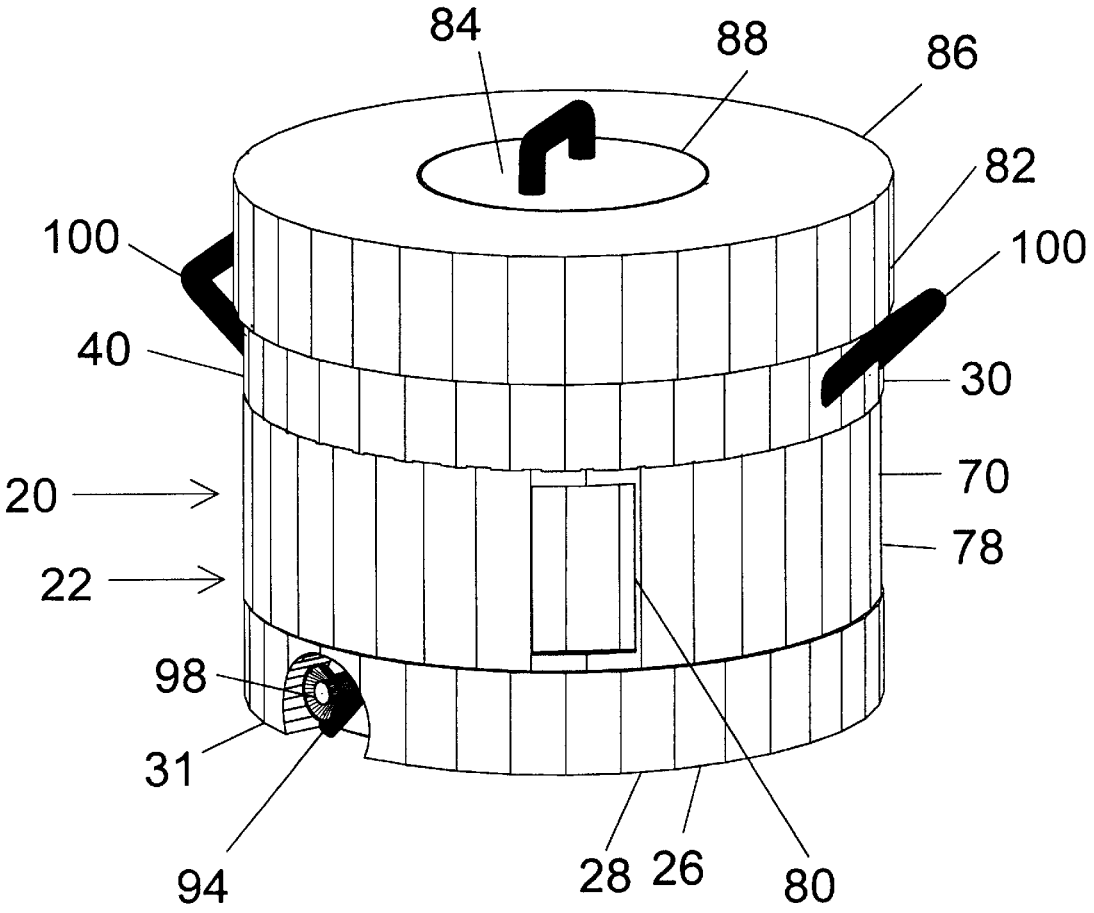
FIG. 1 shows a front perspective view of the first preferred embodiment with both the inner and outer lids in place and the cowling rotated to hide the beverage cans therein.

The first preferred embodiment of the present invention consists of a cooler with separate compartments for a home-made beverage, beverage cans or bottles and reusable substitute ice packs. An outer cover provides access for loading purposes to both the beverage cans or bottles and the reusable substitute ice packs. An inner cover provides access to the compartment holding the home-made beverage. A spigot at the lower corner of the outside wall of the cooler allows one to access the home-made beverage without exposing it to the environment. A rotatable cowling having an access doorway surrounding the cooler provides easy access to the beverage cans or bottles without the necessity of unscrewing the outer lid to access them. The rest of this description shows Applicant's invention being used with beverage cans but it is to be understood that beverage bottles could also be used, and it is not intended to limit Applicant's invention to beverage cans only.

Thus, the Cold Can Cooler Dispenser is a water cooler modified so that it can also dispense cold canned beverages independently through a door in a rotating cowling. And it dispenses a home-made beverage through the spout of the cooler.

What I did was put four cylinders into the wall of a keg type water cooler. These four cylinders are about the same circumference as a twelve ounce canned beverage. The tubes should be made long enough to house between two and three cans stacked on top of one another. The tubes should have an opening on their lower side matching an opening cut in the wall of the cooler, the same size as the canned beverages. The exterior of the cooler has a cowling around it. This cowling rotates around the cooler in a sliding action by simply sliding the handles which are attached to the cowling. The cowling also has an opening in it the size of the twelve ounce canned beverage. Now when you slide the cowling around and its opening comes to and aligns with the opening in the side of the cooler and thus with the opening in one of the four cylinders, a canned beverage will pop out. My invention still does all the functions of a regular cooler, with the spout for dispensing the home-made beverage contained therein or for draining the cooler.

The second preferred embodiment which is used to retrofit existing coolers (which provides all the features of the first preferred embodiment except for isolation of ice from the home-made soft drinks) consists of a tube-like can dispenser for holding canned drinks. A flange gasket is placed over the protruding walls of the flange of the can dispenser and pressed flush against the flange proper. An opening is then cut in the side of the cooler just large enough for the protruding walls of the flange of the dispenser to fit through, and small holes are drilled through the cooler shell for flange screws to be inserted. Then the can dispenser is placed within the cooler cavity. The flange of the dispenser is pressed, protruding walls first, into the cut-out opening causing it to project through the cooler wall. The exterior flange is placed so that its screw holes line up with the screw holes in the cooler wall. The screws are then inserted in the screw holes of the exterior flange, and are successively pushed through the screw holes in the exterior walls of the cooler, through the screw holes in the flange gasket, and then the screws are screwed tightly into the flange.

DETAILED DESCRIPTION OF THE ELEMENTS

Detailed Description of the Elements of the First Preferred Embodiment

Turning now descriptively to the drawings, in which similar reference characters denote similar elements throughout the several views, FIG. 1 illustrates the front perspective view of a cooler.

Figure 2:
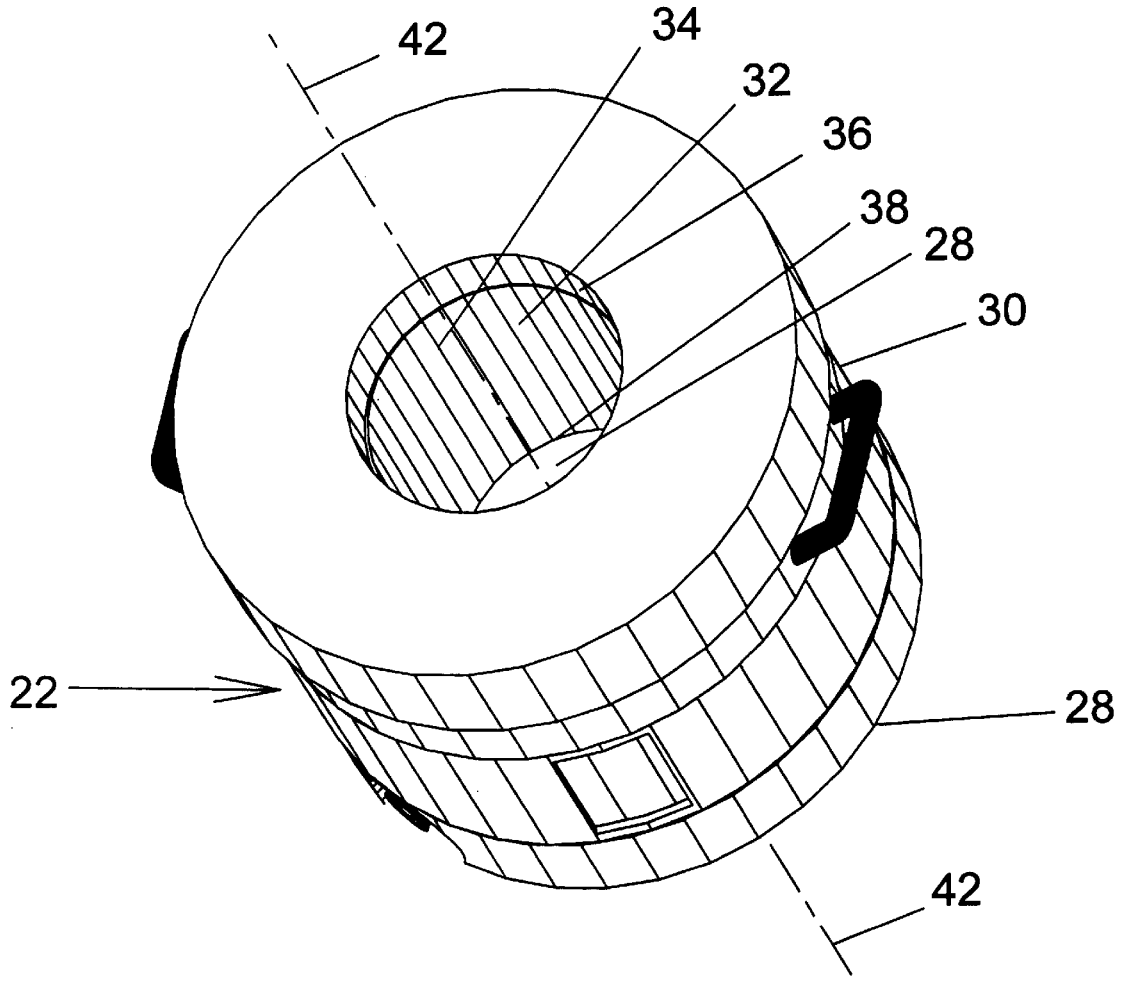
FIG. 2 shows a top perspective view of the first preferred embodiment with the inner lid removed.
Figure 4:
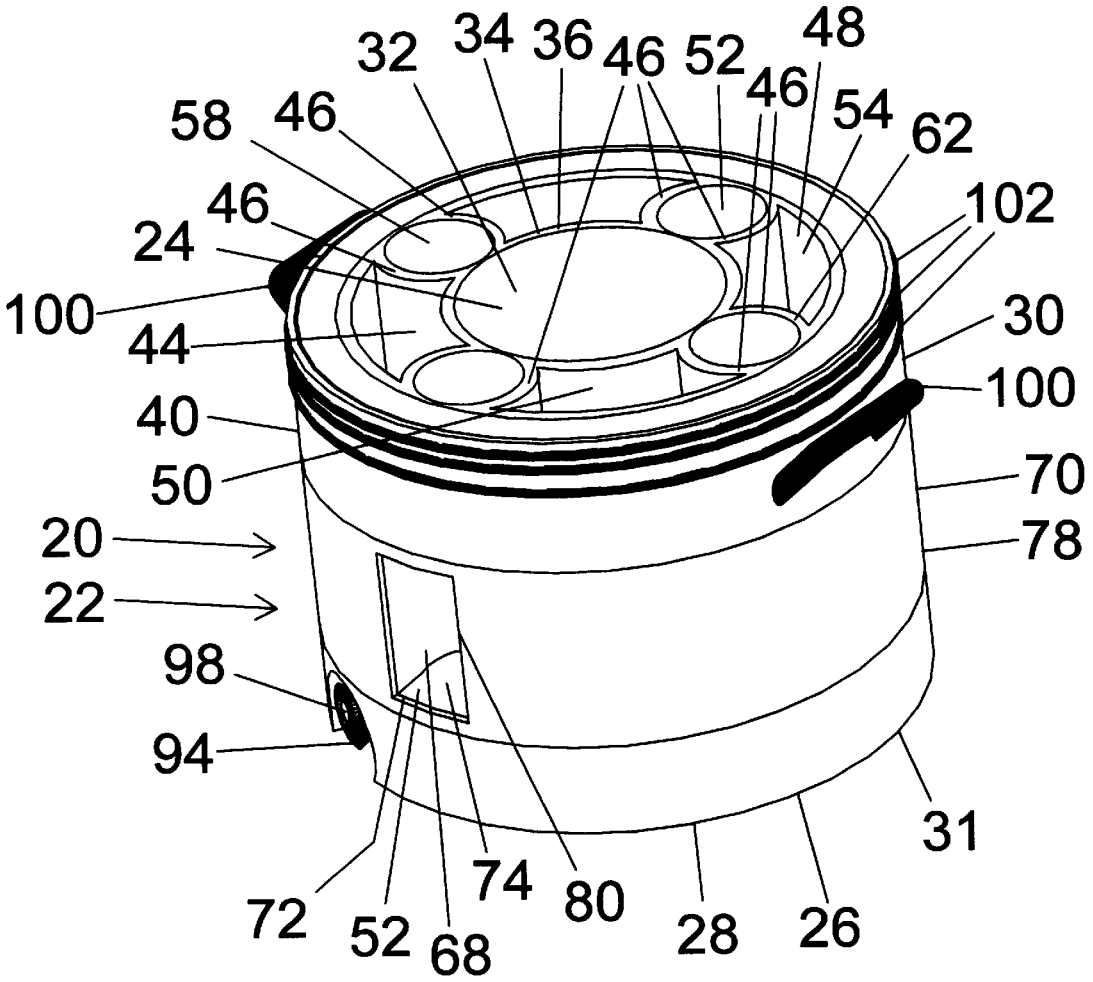
FIG. 4 shows a front perspective view of the first preferred embodiment, with both the inner and outer lids removed and the cowling rotated to reveal one of the compartments for beverage cans.
Figure 8:
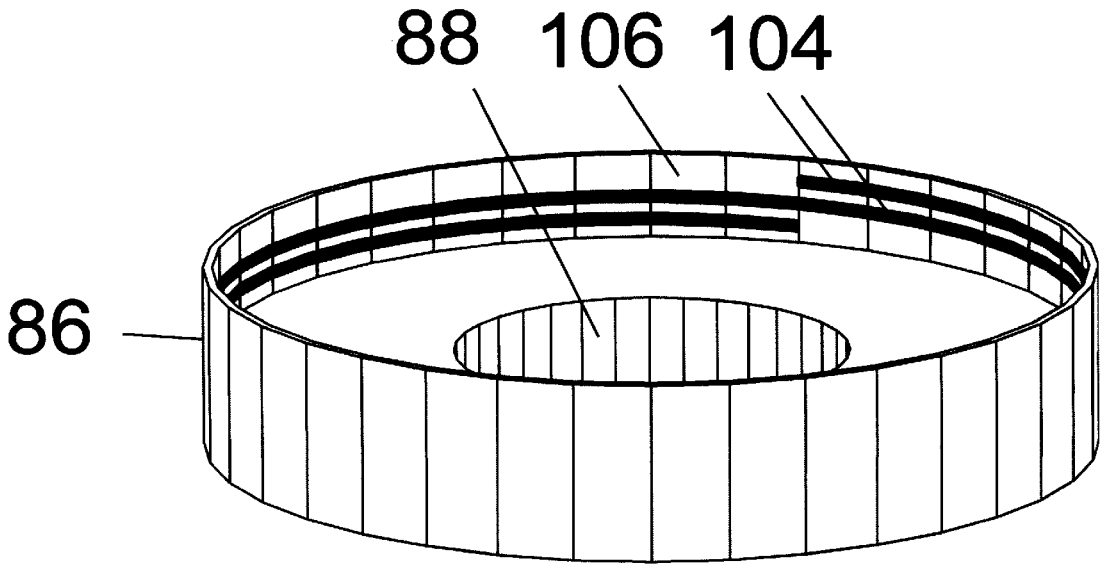
FIG. 8 shows a front perspective view of the outer cover flipped so as to reveal the threads on the inside surface.

As best seen in FIG. 4, the cold can or bottle cooler dispenser, generally shown by reference numeral 20, consists of a generally cylindrically shaped container 22 having an upper open end 24 and a lower closed end 26 which has a thick bottom insulating wall 28. This container 22 which is made of an insulating material such as Ultra Therm insulation has a hard durable outer shell 40 made of such material as plastic or a galvanized metal. On the upper portion of the outer shell 40 are threads 102, which enable a lid 82 (FIG. 1) to be screwed on. (As can be best seen in FIG. 8 the outer lid 86 has threads 104 on its inside walls 106.) The side wall 30 of the container taken with the bottom insulating wall 28 defines an interior region 32. Within this interior region 32 is a hollow structure for holding a beverage 34 (best shown in FIG. 2). Preferably as shown in FIG. 2, this hollow structure 34 has a cylindrical shape. This hollow structure 34 is open at the upper end 36 and has the same height as the side wall 30. The lower end 38 of the hollow structure 34 is attached to the bottom wall 28 of the container 22 which is best shown in FIG. 2. The hollow structure 34 is centrally disposed within the interior region 32 of the container 22 and is aligned with the central axis 42 of the container.

Figure 5:
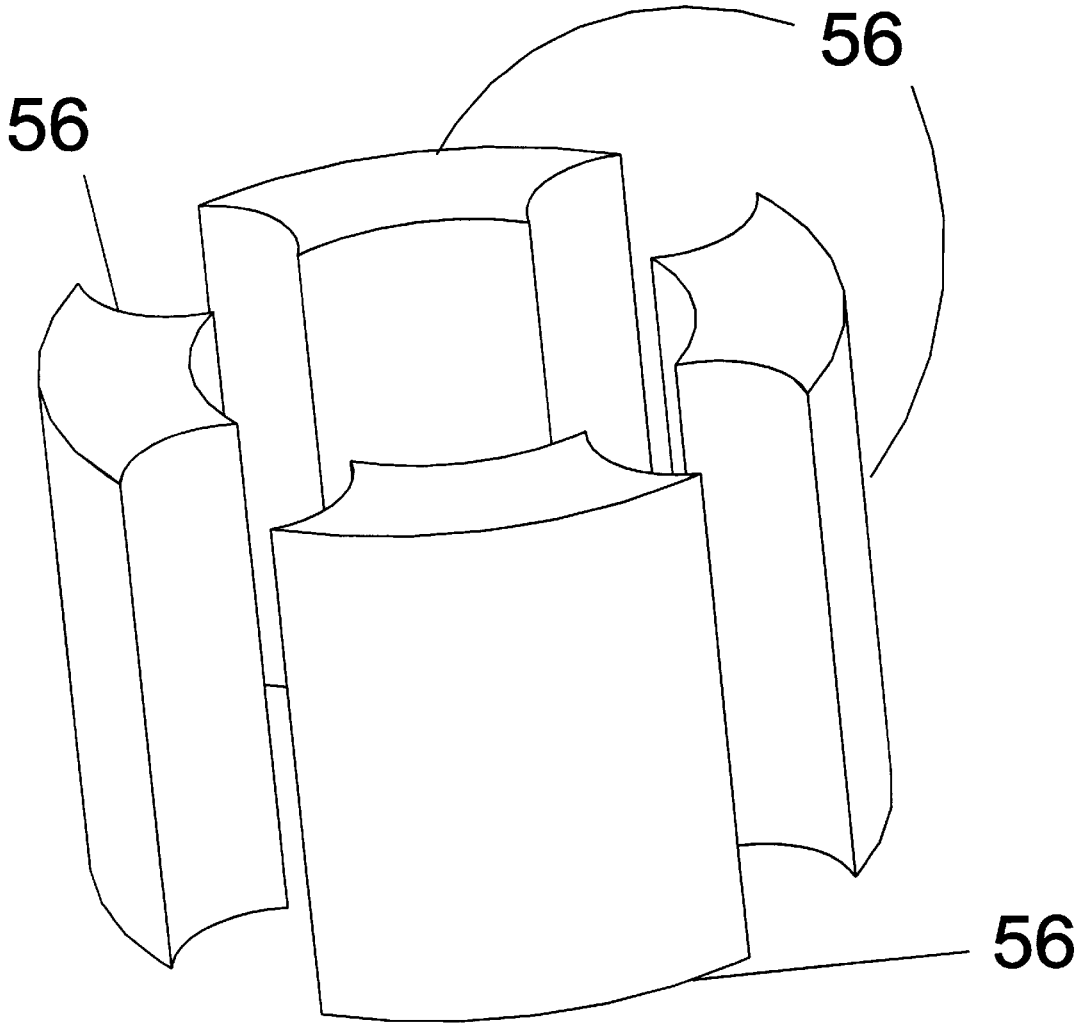
FIG. 5 shows a front perspective view of the reusable substitute ice packs used to cool the first preferred embodiment.

The portion of the interior region 32 between the container 22 and the hollow structure 34 defines a space 44 (FIG. 4). Within this space 44 is a plurality of partitions 46 which extend from the inner surface 48 of the side wall 30 to the outer surface 50 of the hollow structure 34. These partitions 46 are attached to the bottom wall 28 of the container and have substantially the same height as the side wall 30 of the container. These partitions 46 divide the space 44 into an alternating series of compartments for holding twelve ounce beverage cans 52 and compartments for holding cooling means 54 such as ice cubes, dry ice, or reusable ice substitute packs 56. The shape of these reusable ice substitute packs 56 can be best seen in FIG. 5. Each of the compartments 52, 54 has an upper open end 58 and is bounded by a section of the side wall 30. Preferably, the partitions 46, 46 at each end of a beverage can compartment 52 are curved or bowed so as to conform to the shape of a beverage can 60. The result of this bowing of these partitions 46, 46 is that the beverage can compartments 52 are essentially cylindrical tubes 62, and the exterior surface 64 (FIG. 7) of these cylindrical tubes 62 will contact the side wall 30 only along a very narrow vertical strip 66 of the side wall 30. As shown in FIG. 4, this is quite nearly the case with my preferred embodiment. Each of the compartments for holding cans 52 is made of sufficient size to accommodate at least one beverage can 60. Preferably, the compartments for holding cans 52 are made of sufficient height to accommodate two or more beverage cans 60 stacked upon each other. Preferably, the lower end 68 (FIGS. 4, 7) of each compartment for holding cans 52 is angled outward with respect to the center of the container 22, whereby when the cowling 70 is rotated such that its doorway 80 is aligned with one of the openings 72 in the side wall 30, a beverage can is readily propelled therefrom. Most preferably, each compartment for holding cans 52 has a slanted floor 74 at the lower end 68 thereof which slants down and away from the central axis 42 of the container thus angling downward from the portion of the floor 74 closest to the hollow beverage containing structure 34 to the portion of the floor 34 closest to the opening 72 in the side wall 30 thus further facilitating the propulsion of cans 60 from the beverage can compartment 52 when the cowling 70 is sufficiently rotated so that its doorway 80 is aligned with the opening 72 in the side wall 30 of this beverage compartment 52. Thus each of the compartments for holding cans 52 has an upper open end 58 for receiving beverage cans 60 and has an opening 72 in the section of the side wall 30 near its lower end 68 for dispensing beverage cans 60.

A means for shielding and accessing beverage cans 78 is provided for covering or accessing the openings 72 in the side wall 30. This means for shielding and accessing 78 is capable of being moved with respect to the side wall 30, thus enabling a beverage can 60 to be retrieved from the container 22. In my cooler 20, the means for shielding and accessing 78 consists of a rotatable cowling 70, which surrounds the outside of the cooler and is rotatable with respect to it. The cowling 70 has a doorway 80 through which beverage cans 60 can be retrieved. This rotatable cowling 70 provides means for covering and for accessing the openings 72 in the side wall 30, thus providing access to the beverage cans 60 held therein. Preferably the cowling 70 is made of transparent plastic, so that one can readily determine at a glance whether the beverage can compartments 52 of the cooler 20 have been fully loaded with beverage cans 60 before departing for the beach.

Figure 3:
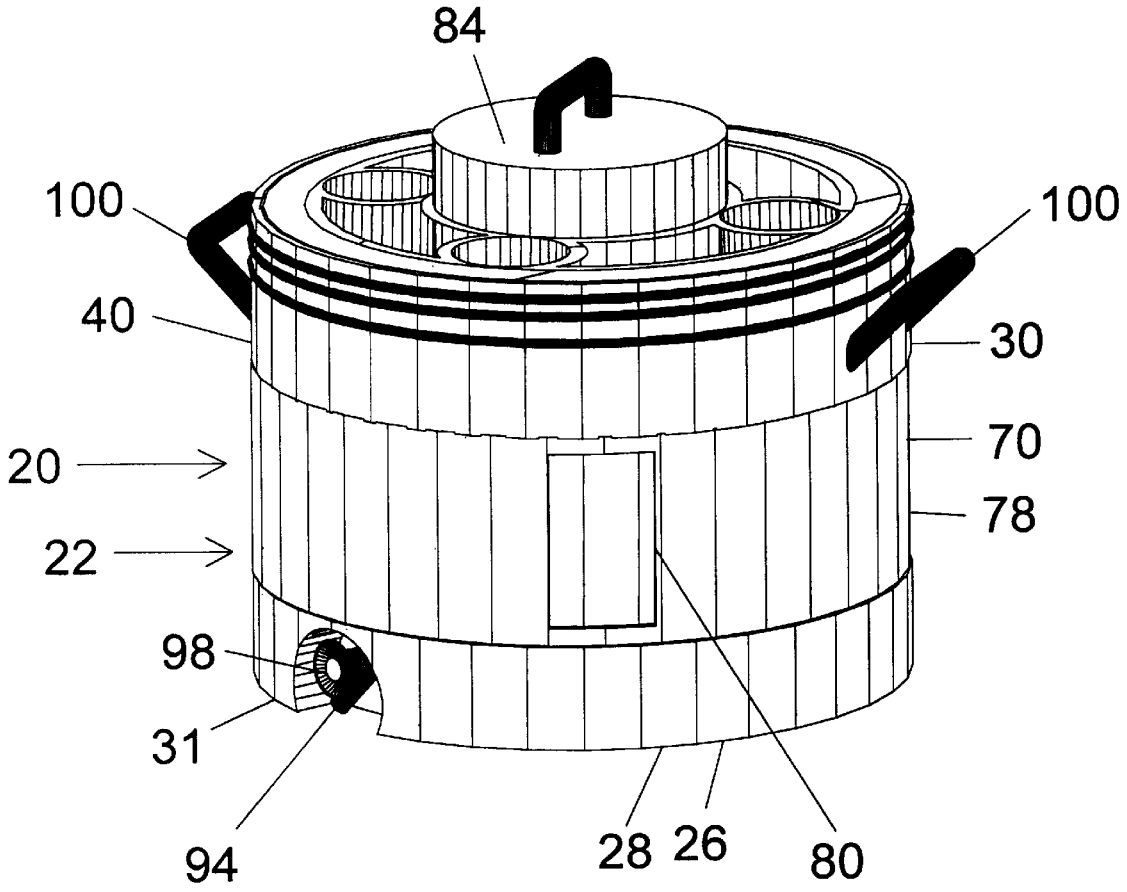
FIG. 3 shows a front perspective view of the first preferred embodiment with the outer lid removed.

As shown in FIG. 1, a lid 82 of either the press down or screw-on type covers the upper open end 24 of the container 22. As can be best seen in FIG. 8, the outer lid 86 of the outer lid/inner lid combination 82 has threads 104 on its inside walls 106. These threads enable the lid 82 to be screwed on the top of the cooler which has threads 102 on the outside walls 30 of its hard durable outer shell 40. In the preferred embodiment, an inner lid of the push down type 84 (best seen in FIG. 3) covers just the hollow structure 34, and an outer lid of the screw-on type 86 (best seen in FIGS. 2 and 8) having an opening 88 in the center thereof covers just the compartments for holding beverage cans 52 and the compartments 54 for holding the reusable substitute ice packs 56. The opening 88 in the outer lid 86 is made of sufficient size to allow one to remove or replace the inner lid 84 while the outer lid 86 remains in place. Likewise, one may remove the outer lid 86 from the container 22 to access the contents of the compartments for holding cans 52 and the compartments for holding ice or reusable substitute ice packs 54 while the inner lid 84 remains in place. Preferably, the two lids 84, 86 are made of transparent plastic, so that one can readily determine at a glance the status of beverage cans 60, reusable substitute ice packs 56, and home-made beverage therein.

Figure 9:
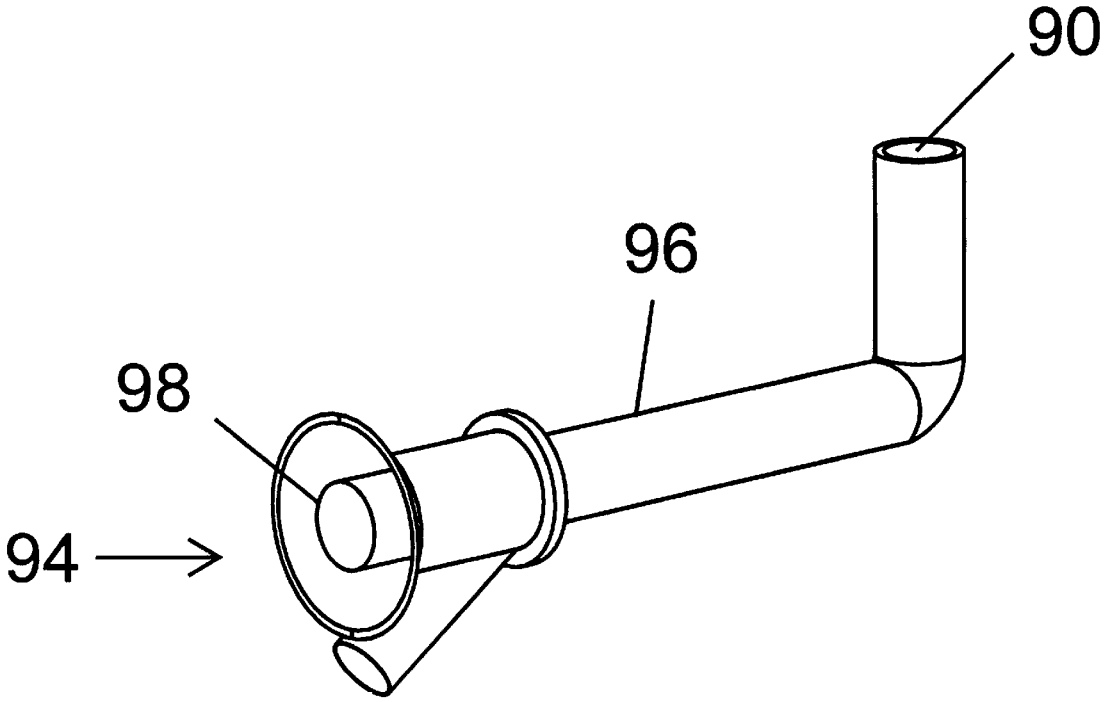
FIG. 9 shows a side perspective view of the spigot and connecting tube.
Figure 10:
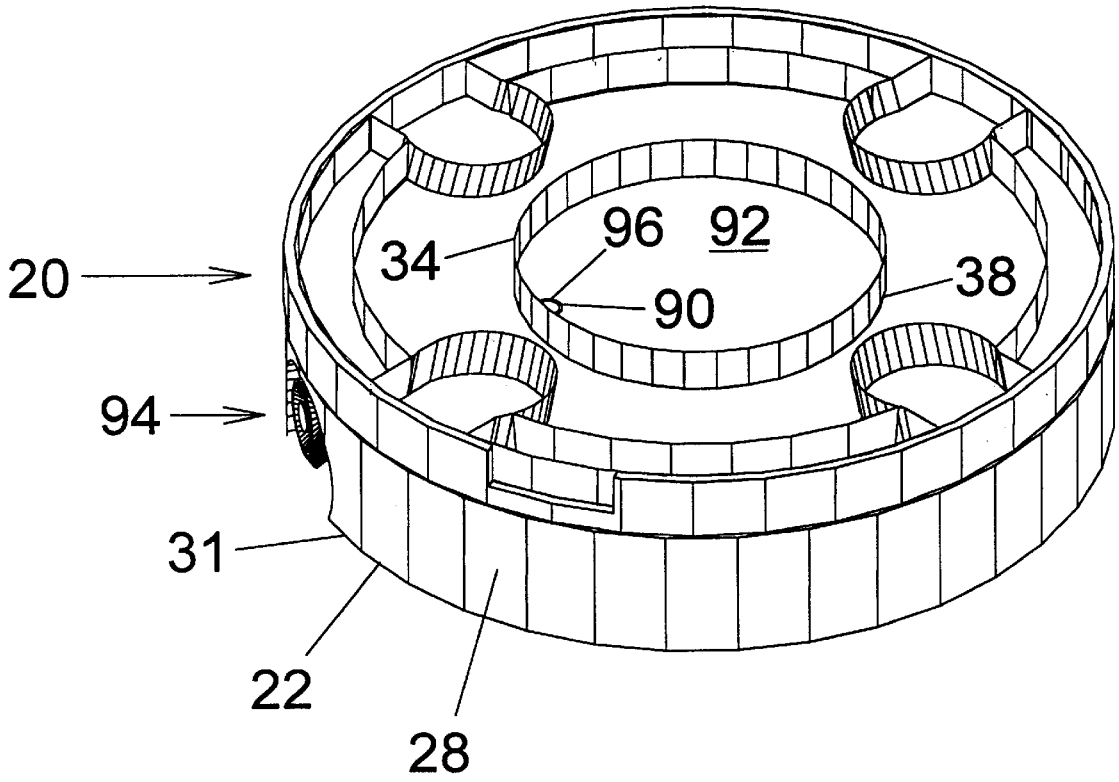
FIG. 10 shows a diagrammatic front isometric view of the first preferred embodiment with the upper half sliced off to reveal a portion of the conduit from the central structure to the exterior spigot.

As best seen in FIG. 10, a conduit 90 leads from the lower end 38 of the hollow structure 34 to near the lower end of the container 22. Preferably, this conduit 90 conducts liquid from an opening 91 in the floor 92 of the beverage-containing structure 34 to a spigot 94 near a lower edge 31 of the outside wall of the cooler 20 via a tube 96 (best seen in FIGS. 9 and 10) embedded in the bottom wall 28 of the container. This conduit 90 terminates in a spigot 94 (best seen in FIG. 9) having an open position (activated by depressing the flow-regulating button 98) and a closed position (activated by releasing the flow-regulating button 98) such that when the spigot 94 is in its open position, any liquid contents within the hollow structure 34 is free to flow through the conduit 90 and out of the spigot 94.

Figure 6:
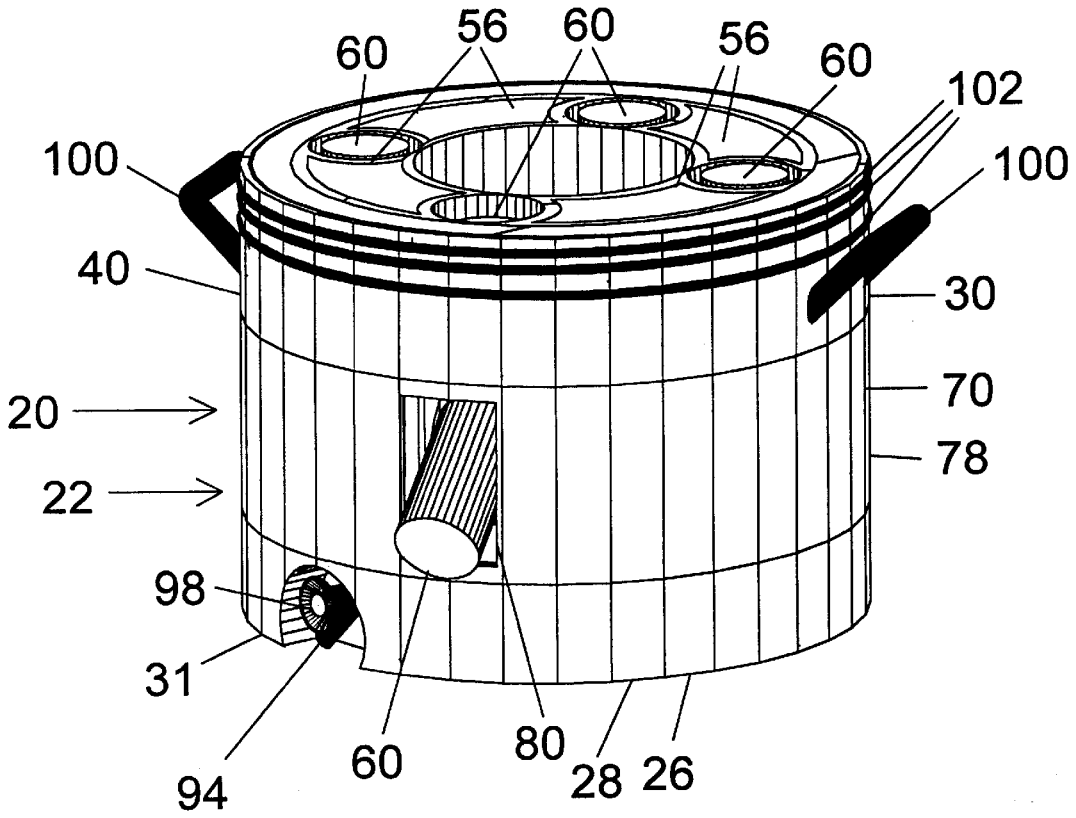
FIG. 6 shows a front perspective view of the first preferred embodiment with both covers removed and loaded with both beverage cans and reusable substitute ice packs, and the cowling rotated so that a beverage can may be retrieved therefrom.
Figure 7:
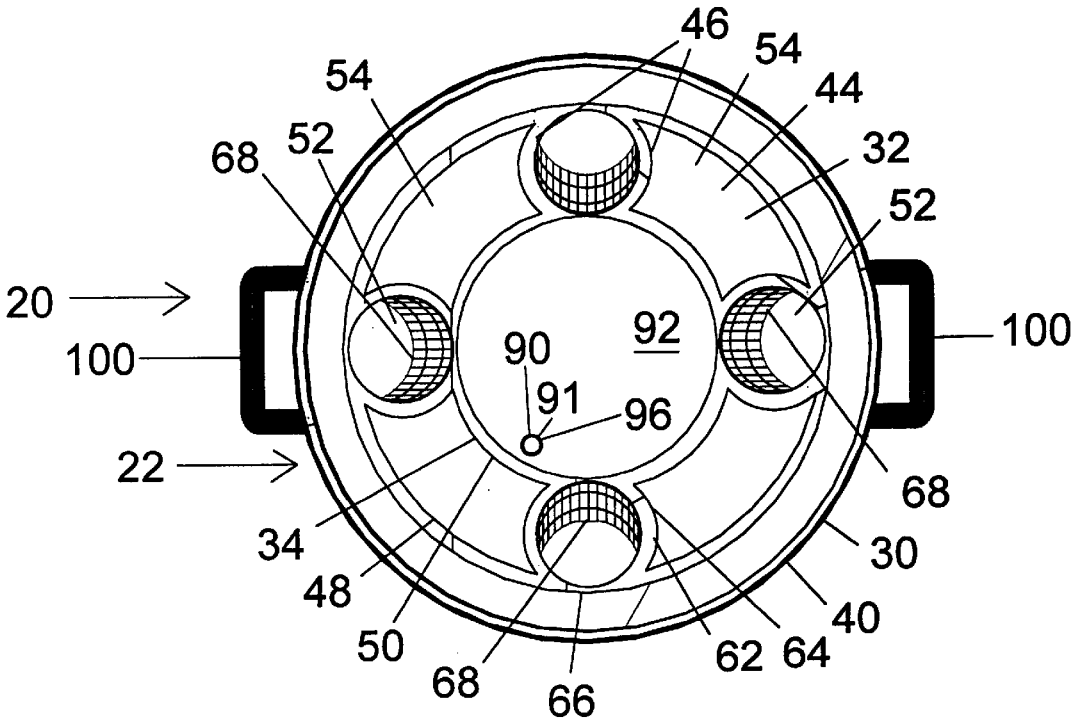
FIG. 7 shows a top view of the first preferred embodiment.

As best seen in FIGS. 6 and 7, handles 100, 100 are fixedly attached to opposite sides of the cooler 20 to facilitate it being carried.

Detailed Description of the Elements of the Second Preferred Embodiment

Figure 11:
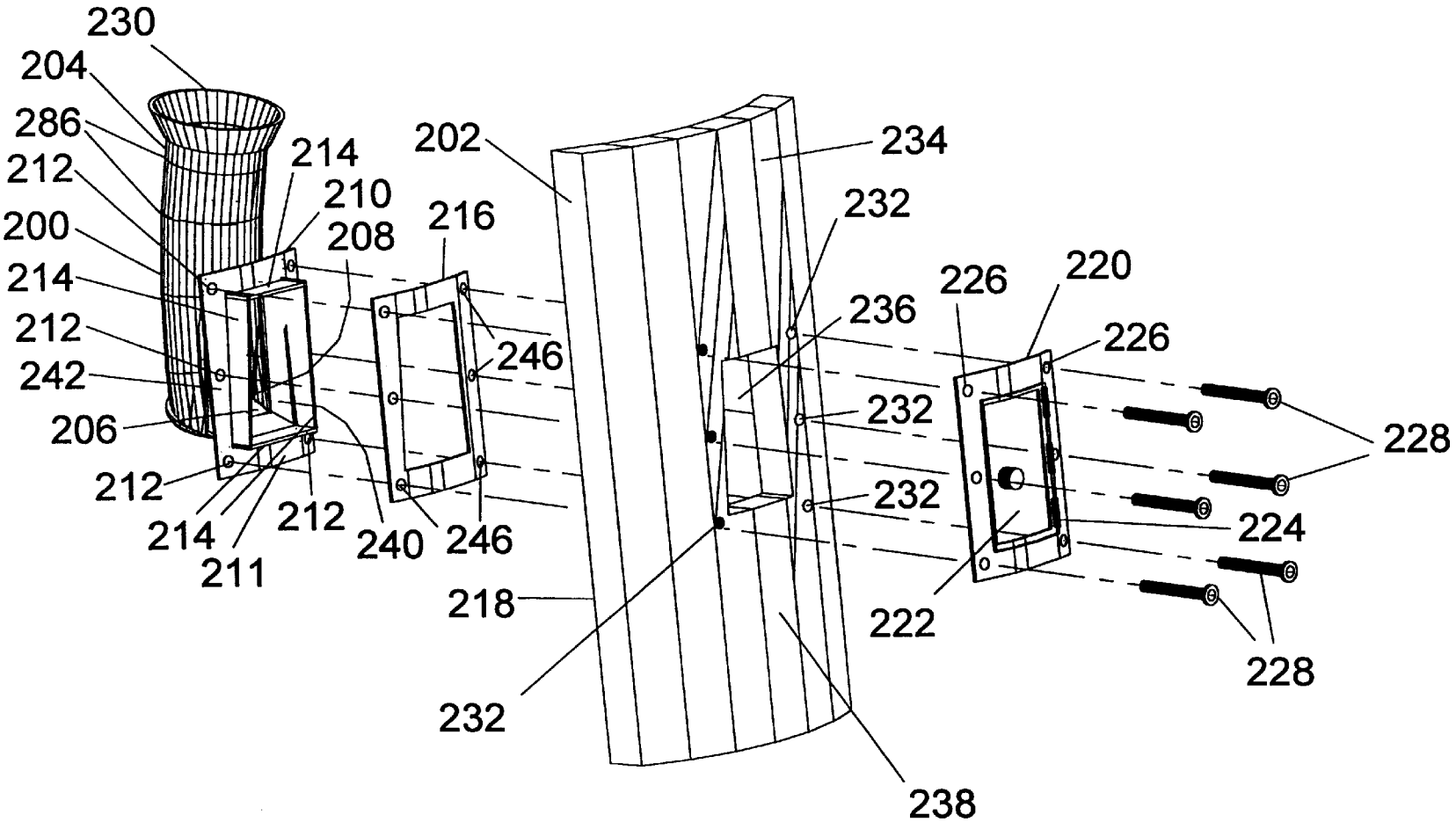
FIG. 11 shows an exploded or assembly perspective view of the second preferred embodiment.
Figure 12:
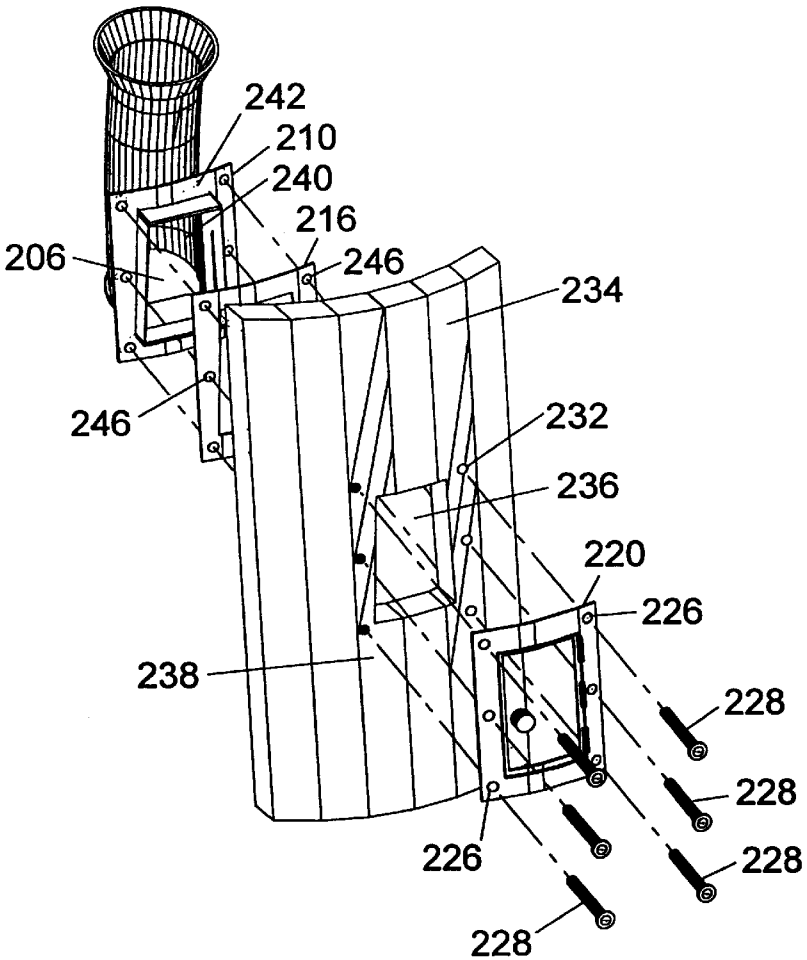
FIG. 12 shows an exploded or assembly isometric view of the second preferred embodiment.
Figure 13:
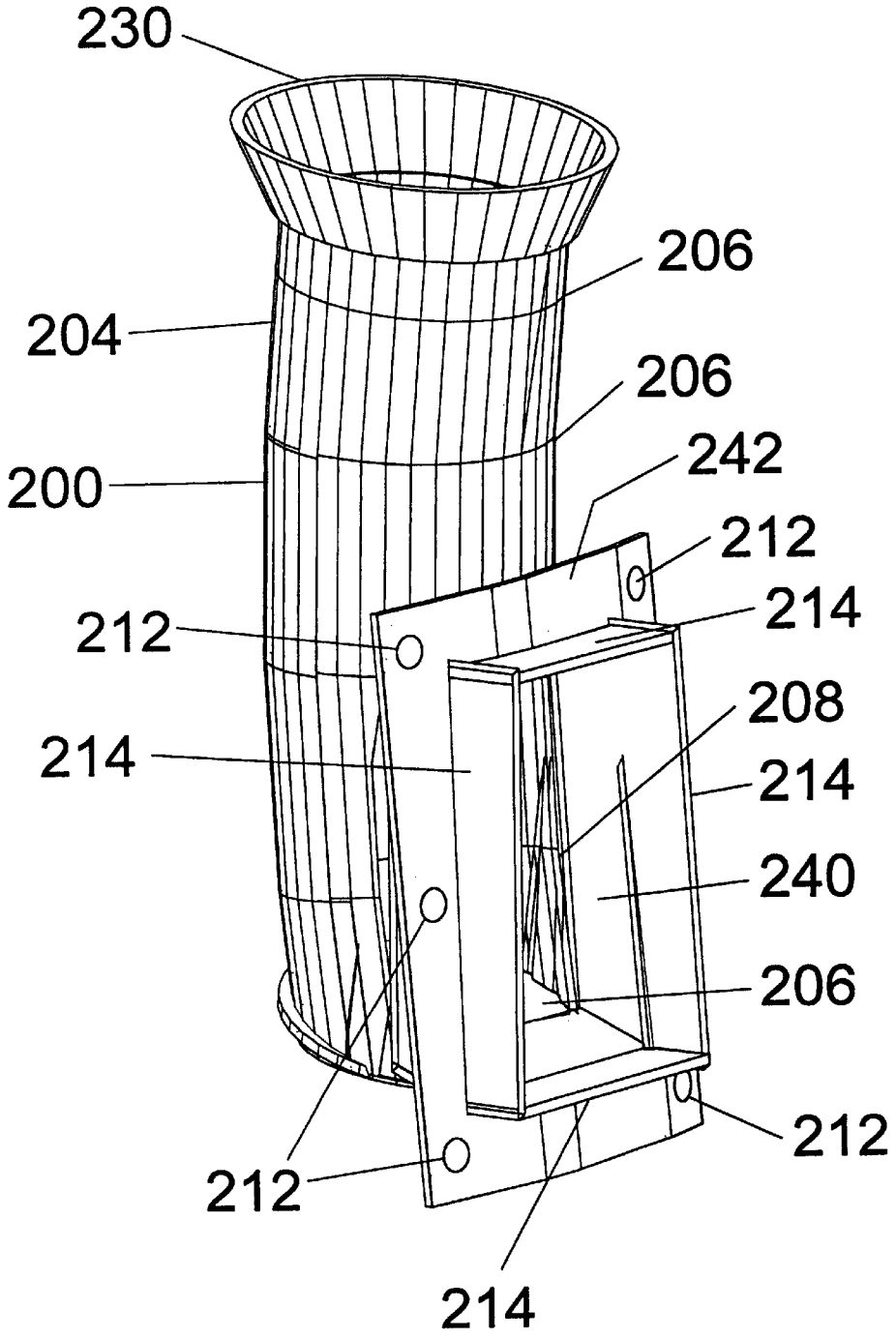
FIG. 13 shows a perspective view of the plastic cylinder and flange portion of the second preferred embodiment.
Figure 14:
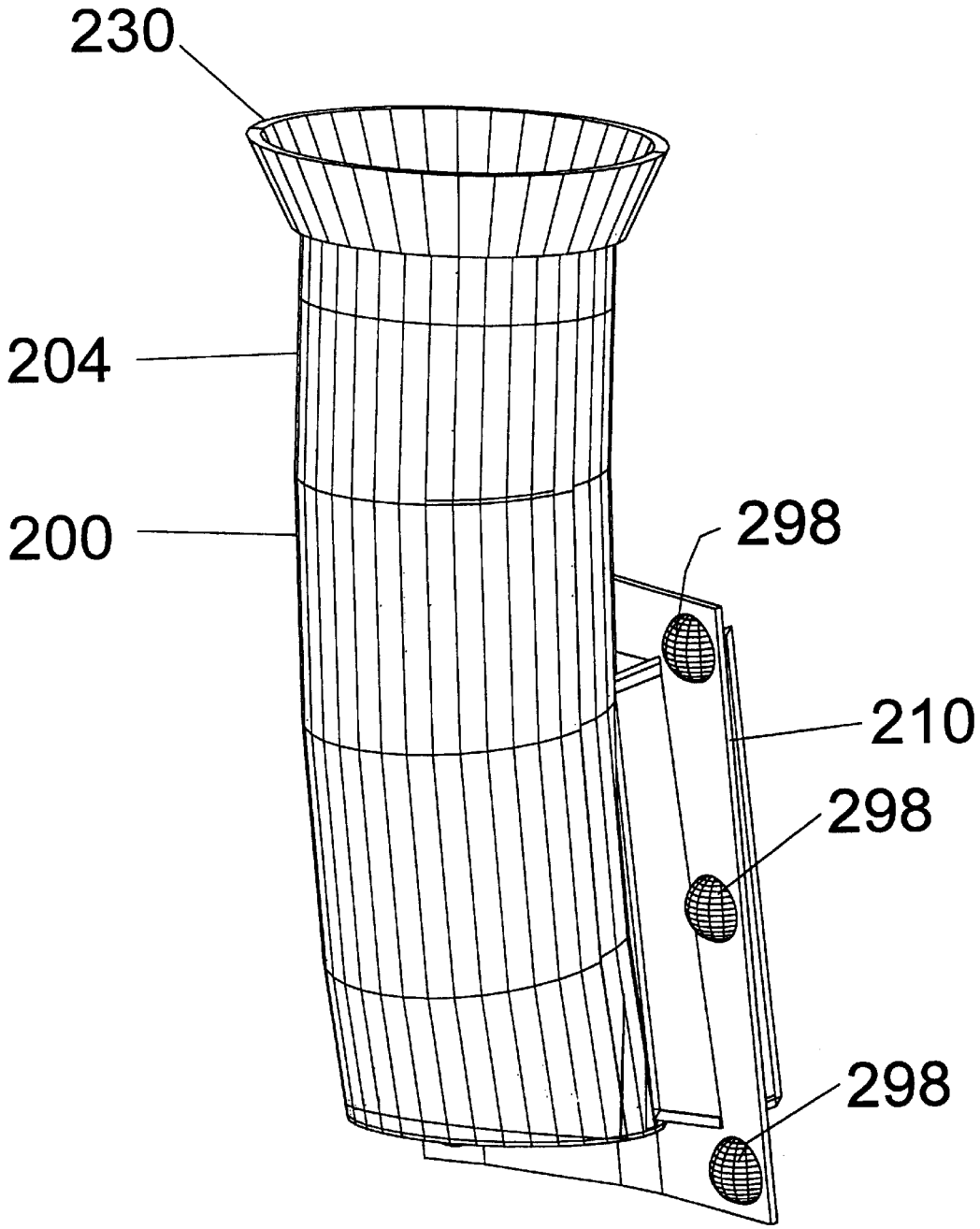
FIG. 14 shows a perspective view of the back of the plastic cylinder and flange portion of the second preferred embodiment showing the protruding knobs into which the flange screws are ultimately screwed.

In the second preferred embodiment of the instant invention shown fully in FIGS. 11 and 12, a cold can cooler dispenser is made by adding a can dispenser 200 to an existing cooler. (A portion of the wall of the cooler is indicated by reference number 202.) This can be done by taking a plastic cylinder 204 that is just a little wider in circumference than a beverage can and long enough to house at least one but preferably three canned beverages. It should have a slightly pitched floor 206 on the bottom of the cylinder 204. Secondly, on the lower side of that cylinder 204 there would be an opening 208 in the side approximately the size of the canned beverage. Thirdly, there would be a flange 210 around the exterior of this hole on the cylinder. This flange 210 would be approximately one inch deep and would have at least four and preferably six threaded screw holes or sleeves 212, these sleeves acting as nuts. Fourthly, on the inside perimeter of the flange 210, there will be four walls 214 protruding out approximately one inch or the width of the average interior wall of a cooler. This should all be one piece.

Preferably, there is a gasket 216 between the flange 210 and the interior wall of the cooler 218. This gasket 216 can be made from a variety of materials, such as fiber, adhesive, silicon, or some other water tight materia.

Figure 15:
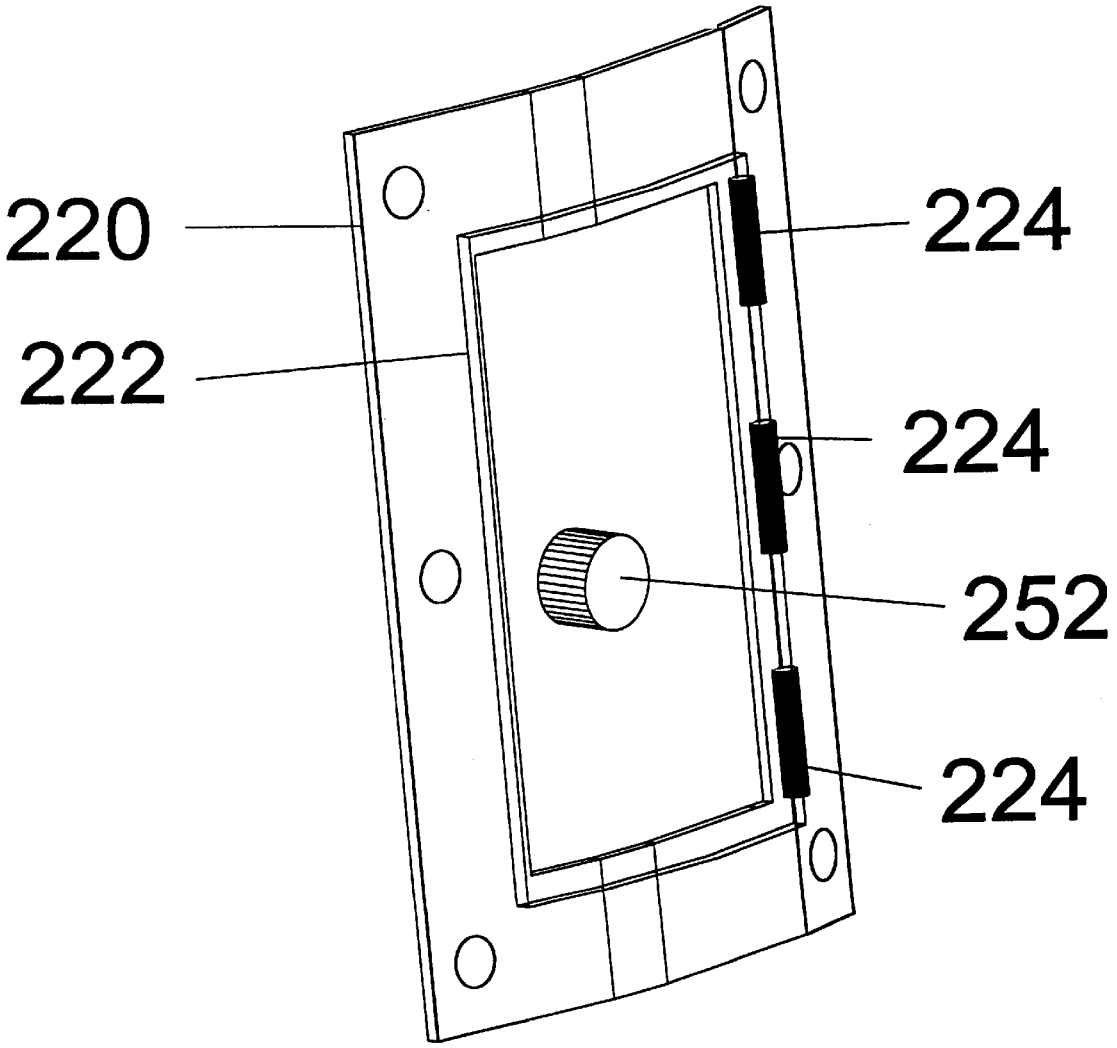
FIG. 15 shows a perspective view of the exterior flange of the second preferred embodiment.
Figure 16:
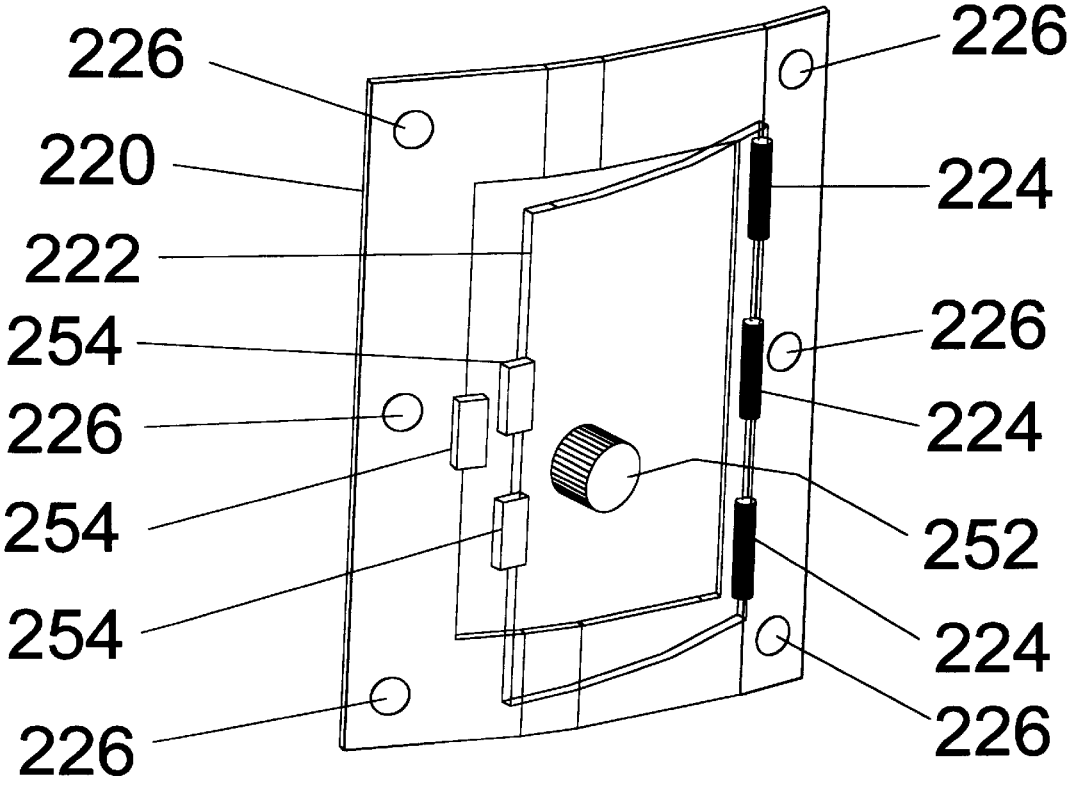
FIG. 16 shows an isometric view of the exterior flange of the second preferred embodiment with the clear door slightly open.
Figure 17:
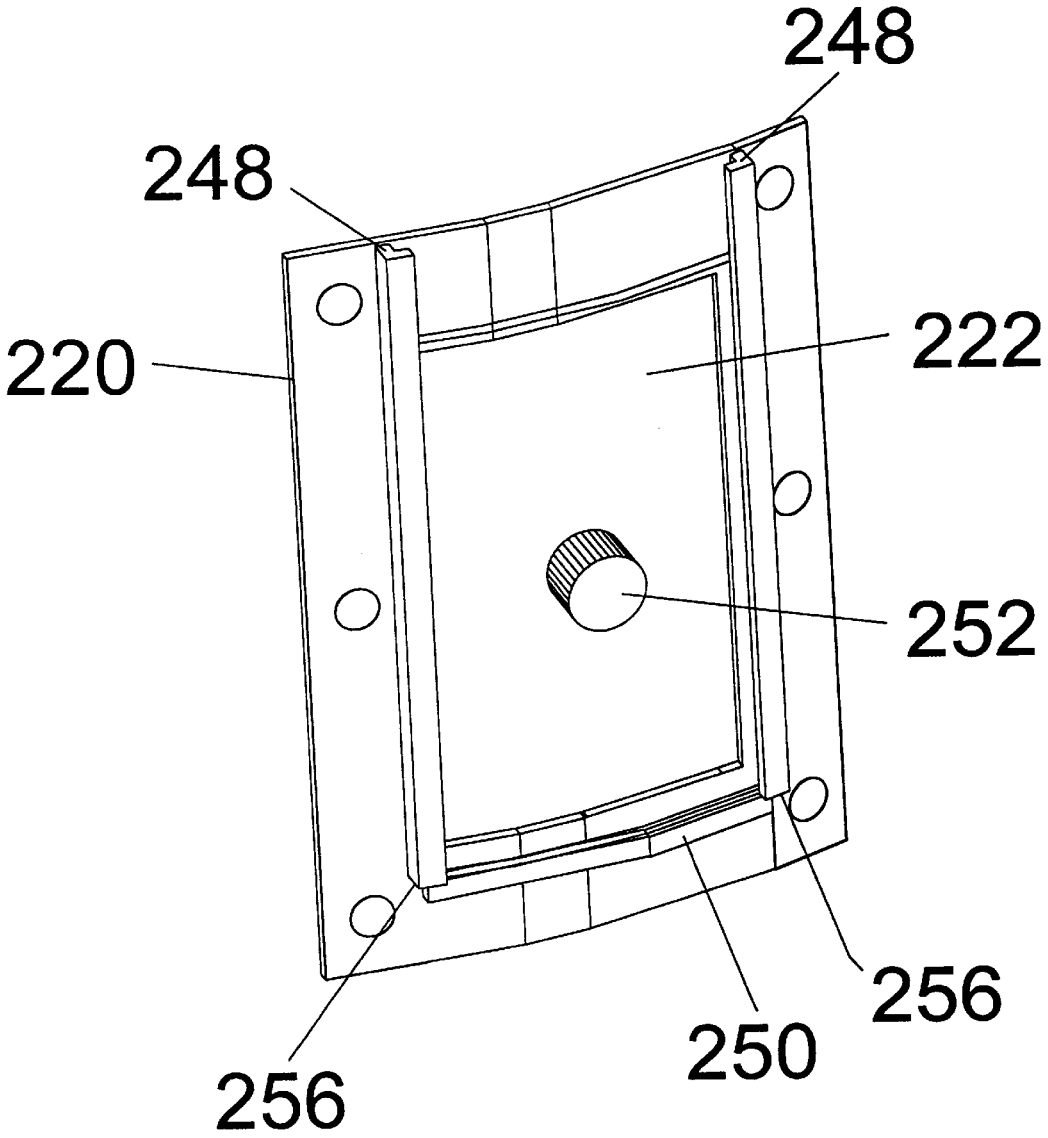
FIG. 17 shows an isometric view of another embodiment of the exterior flange of the second preferred embodiment with the clear door slidable within two vertical tracks.

As best seen in FIGS. 15, 16, and 17, the plastic exterior flange 220 has a clear plastic door 222 which can be opened by means of handle 252 to obtain a can of beverage behind the door 222. Preferably, as shown in FIG. 17, the plastic exterior flange 220 has two vertical channels 248 within which the door 222 rides as it is raised or lowered. A lower ledge 250 acts as a stop for the door. This flange 220 is the same size as the flange 210 attached to the dispenser 200. It has the same number of screw holes 226 therein, and these holes 226 are aligned with the screw holes in the flange 210 of the dispenser 200.

In a lesser preferred embodiment of the exterior flange 220, as shown in FIGS. 15 and 16, the plastic exterior flange 220 has the clear plastic door 222 attached to it by hinges 224. One of the many latch mechanisms taught in the latch mechanism art can be used to keep the door 222 closed until it is desired to open the door to obtain a canned beverage from behind the door. Such a latch mechanism is diagrammatically shown by reference number 254 in FIG. 16. The flange 220 is the same size as the flange 210 attached to the dispenser 200. It has the same number of screw holes 226 therein, and these holes 226 are aligned with the screw holes in the flange 210 of the dispenser 200.

The screws 228 which are used to secure the dispenser 200 to the cooler wall can me made of a material such as nylon, metal or stainless steel, for examples. They would have to be at least three-sixteenths of an inch longer than the thickness of the cooler wall.

Preferably, the dispenser cylinder 204 has slightly engraved circular indentations 286 around the top perimeter of the cylinder in different areas where the cylinders could be cut so as to fit different size coolers. Afterwards, one would put the top gasket 230 wherever the cut was made to ensure that the cylinder 204 would not leak at the top. The top gasket 230 should fit snugly tight on top of the dispenser's cylinder 204.

Preferably, a template will be used to ensure proper cutting of the cooler and proper drilling of the screw holes 232 in the side wall 202 of the cooler.

Preferably, as mentioned above, a gasket 216 should be mounted on the flange 210 of the dispenser 200—this gasket 216, therefore, will be between the flange 210 of the dispenser 200 and the interior wall 218 of the cooler, and it will serve to eliminate leakage from the cooler after the instant invention is installed thereon.

The exterior flange 220 is mounted on the exterior wall 234 of the cooler. Its screw holes 226 are aligned with the screw holes 232 which were previously drilled in the exterior wall 234 of the cooler. A clear plastic door 222 is mounted on the outside of the exterior flange 220 and, in a lesser preferred embodiment of the exterior flange, is connected thereto by a hinge 224. In the more preferred embodiment of the external flange, vertical channels 248 are mounted on the outer wall of the exterior flange. These vertical channels guide the door as it is raised and lowered. A door stop 250 prevents the door 222 from slipping out of the lower ends 256 of the vertical channels 248.

An existing cooler can be retrofitted with the second preferred embodiment of the instant invention as follows: An opening 236 is cut in the lower portion 238 of the exterior wall 234 of a keg type water cooler. This opening 236 has the same dimensions as the opening formed by the ends of the four protruding walls 214 coming out from the flange 210 of the dispenser. The flange gasket 216 is fitted around the walls 214 of the flange 210, and is slid up against the back wall 211 of the flange 210. As previously mentioned, the flange gasket 216 can be made of fiber, adhesive, silicon, or some other type of watertight material. Now that the flange gasket 216 is mounted on the flange 210, the four protruding walls 214 of the flange 210 of the dispenser are inserted into the opening 236 which was cut in the lower wall 238 of the cooler. Finally, one places the exterior flange 220 on the outer wall of the cooler where the opening 236 in the side of the cooler is, and lines it up with the screw holes 232 in the exterior wall 234 of the cooler. Then the screws 228 are inserted in the screw holes 226 of the exterior flange 220, and the tips of the screws are pushed successively through the screw holes 232 in the exterior walls of the cooler, the screw holes 246 of the flange gasket 216 and the threaded screw holes 212 of the flange 210 of the dispenser. (Note that on the back of the flange 210 are six knobs or protrusions 298 which are partially threaded and into which the tips of the screws enter as they are turned tight. The purpose of the knobs 298 is to ensure that the screws tips do not come in contact with the contents of the cooler.) Now as the screws 228 are turned till they are tight, this draws the exterior flange 220, the flange gasket 216, and the dispenser's flange 210 water-tight against the interior and exterior walls of the cooler.

ADVANTAGES OF THE INVENTION

My invention, the Cold Can Cooler Dispenser has many advantages over the typical cooler. My invention holds canned beverages and a liquid beverage at the same time and eliminates the possibility of germs from people's hands contaminating a home-made beverage in the cooler. With existing coolers, people often put their canned beverages into the ice water (such as workers who bring drinks and drinking water to job sites) and then stick their dirty hands in the clean drinking water to retrieve their cans causing germs to contaminate the once clean water. With my new invention, since the home-made beverage is segregated from the canned drinks, the beverage is kept clean, germ free, and cold. In addition with my first preferred embodiment, the home-made beverage is segregated from the ice packs also, thus ensuring that the beverage cans stay dry on the outside. This invention will be very useful to many types of people who will now be able to have germ free water and dry-on-the outside canned beverages.

Various types of drinks can now be brought together. Canned drinks such as sodas and beer can be brought to a picnic along with a home-made liquid drink such as Kool-Aid or iced tea.

Once the Cold Can Cooler Dispenser is full, there will not be a need to reopen the lid. This permits everything to stay colder longer. The home-made beverage can be dispensed from the spout, and the cans can be obtained by rotating the cowling until its opening is aligned with one of the doors in the side of the cooler.

This new cooler will also keep people from rummaging around with their hands in the cold beverage trying to find their favorite beverage. With my new cooler, one need simply open a door, and one's beverage is dispensed neatly and cold.

Yet another advantage with this cooler is only having to carry around one cooler. Instead of having to bring a different cooler for each different type of drink, one cooler serves both types conveniently--everything you need in one cooler.

As more and more people are becoming aware of the importance of healthy, germ-free ways of eating, drinking, and living, this cooler will be found to be a vital necessity for today's public for numerous reasons. My new cold can cooler dispenser will be a cooler that is both for fun and for the health conscious here and around the world.

The previously described cooler has many advantages, including:

Sanitary. After one prepares a home-made beverage, pours it into the central structure of the cooler, and seals it with the push-down central lid, the push down central lid need never be removed until the cooler is brought back home for cleaning. After the push-down lid is secured, reusable substitute ice packs and beverage cans may be loaded by unscrewing the outer lid, thus leaving the home-made beverage unexposed to the environment.

When at the beach, home-made beverage is retrieved via the external spigot. Canned beverages are obtained by rotating the external cowling.

Contents Quickly Accessible. Home-made beverage obtained by depressing the flow-regulating button of the spigot. Canned beverages obtained by twirling the cowling.

Full-Strength Home-Made Beverage. Since the cooling means is physically separated from the home-made beverage, it will not become diluted over time.

Dry beverage cans. Since the cooling means is physically separated from the beverage cans, they will remain dry, and consequently will be easy to handle.

Convenient. Home-made beverage, cooling-means, and beverage cans are all carried in one compact container. Furthermore there is no need to rummage around in the ice in the cooler to obtain a canned drink as is the case with many prior art coolers. A canned drink is easily obtained just by twirling my cooler's cowling.

5.4 LIST OF REFERENCE NUMBERS

| | |
|---|---|
| 20 | cold can or bottle cooler dispenser |
| 22 | cylindrically shaped container |
| 24 | upper open end of cylindrically shaped container |
| 26 | lower closed end of cylindrically shaped container |
| 28 | bottom insulating wall of container |
| 30 | side wall of the container |
| 31 | lower edge of outside wall of container |
| 32 | interior region |
| 34 | hollow structure for holding a beverage |
| 36 | upper end of hollow structure |
| 38 | lower end of hollow structure |
| 40 | hard durable outer shell |
| 42 | central axis of container |
| 44 | space between container and hollow structure |
| 46 | partition |
| 48 | inner surface of side wall |
| 50 | outer surface of hollow structure |
| 52 | compartment for holding a beverage can |
| 54 | compartment for holding cooling means |
| 56 | reusable ice substitute pack |
| 58 | upper open end of compartment |
| 60 | beverage can |
| 62 | cylindrical tube |
| 64 | exterior surface of cylindrical tube |
| 66 | narrow vertical strip of the side wall |
| 68 | lower end of compartment |
| 70 | cowling |
| 72 | opening in the side wall of the container |
| 74 | slanted floor of compartment for holding beverage cans |
| 78 | means for shielding and accessing cans |
| 80 | doorway of cowling |
| 82 | lid of cooler |
| 84 | inner lid of the push down type |
| 86 | outer lid of the screw on type |
| 88 | opening in the center of outer lid |
| 90 | conduit for home-made beverage |
| 91 | opening in floor |
| 92 | floor of beverage-containing structure |
| 94 | spigot |
| 96 | tube leading to spigot |
| 98 | flow-regulating button of spigot |
| 100 | handle |

-continued

| 5.4 LIST OF REFERENCE NUMBERS | |
|---|---|
| 102 | threads on outer shell of cooler |
| 104 | threads on inside of lid of cooler |
| 106 | inside wall of lid of cooler |
| 200 | can dispenser |
| 202 | portion of wall of a cooler |
| 204 | plastic dispenser cylinder |
| 206 | slightly pitched floor of dispenser |
| 208 | opening |
| 210 | dispenser's flange |
| 211 | back wall of the flange |
| 212 | screw hole or sleeve in flange |
| 214 | wall of flange |
| 216 | flange gasket |
| 218 | interior wall of cooler |
| 220 | plastic exterior flange |
| 222 | clear plastic door |
| 224 | hinge of door |
| 226 | screw hole of exterior flange |
| 228 | screw |
| 230 | top gasket |
| 232 | screw hole in wall of cooler |
| 234 | exterior wall of cooler |
| 236 | opening in wall of cooler |
| 238 | lower portion of wall of cooler |
| 240 | opening formed by walls of flange |
| 242 | back wall of flange |
| 246 | screw hole in flange gasket |
| 248 | a channel for the door of the exterior flange |
| 250 | stop for the door of the exterior flange |
| 252 | door handle |
| 254 | latch mechanism |
| 256 | lower end of a channel |
| 286 | engraved circular indentation |
| 298 | knobs or protrusions on back of dispenser's flange |

It will be understood that each of the elements described above, or two or more together may also find a useful application in other types of devices and methods differing from those types described above.

ALTERNATIVE AND THE CLOSING

Thus the reader will see that my cold can or bottle cooler dispenser supplies a long felt need for a simple, economical, easy to use cooler. If one should aver that my cold can or bottle cooler dispenser is obvious, then one is hard put to explain why families taking their kids to the beach still place beverage cans in with the home-made beverage and ice cubes in their cooler—a very unsanitary practice. As it is, such coolers are currently the only type currently available in the market place.

Although the present invention has been described in considerable detail with reference to certain preferred versions thereof, other versions are possible which will be apparent to those who are skilled in the art. While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention. Therefore, the spirit and scope of the appended claims should not be limited to the description of the preferred versions contained herein, but by the appended claims and their legal equivalents.

What is claimed is:

1. A cold can or bottle cooler dispenser for providing portable storage for a beverage and beverage receptacles selected from the group consisting of beverage cans and beverage bottles, said dispenser comprising:

(a) a generally cylindrically shaped container with a central axis, said container having:

(i) an upper open end and a lower closed end, said lower closed end having a bottom wall of predetermined thickness: and (ii) a side wall of predetermined height and predetermined thickness, said side wall having an upper end, a lower end, an inner surface, and an outer surface, said side wall and said bottom wall of said container defining an interior region;

(b) a hollow structure for holding a beverage, said hollow structure having the same height as said side wall, said hollow structure having an upper open end and a lower end attached to said bottom wall, said hollow structure being centrally disposed within said interior region of said container and aligned with the central axis of said container, said hollow structure having an inner surface and an outer surface, the region between said container and said hollow structure defining a space;

(c) a plurality of partitions extending from the inner surface of the side wall to the outer surface of the hollow structure, said partitions being attached to said bottom wall and having substantially the same height as said side wall, said partitions dividing the defined space into an alternating series of beverage receptacle compartments for holding beverage receptacles and cooling compartments for holding means for cooling beverage receptacles, each of said beverage receptacle compartments being bounded by a section of the side wall, each of said beverage receptacle compartments having a predetermined height, each of said beverage receptacle compartments being sized to contain therein a plurality of beverage receptacles, each of said beverage receptacle compartments having an upper open end for receiving beverage receptacles, each of said beverage receptacle compartments having an opening in said section of the side wall near the lower end thereof for dispensing a receptacle, each of said cooling compartments having an upper open end;

(d) means for shielding and accessing for covering and accessing the openings in the side wall, said means for shielding and accessing being capable of being moved with respect to said side wall, thus enabling a beverage receptacle to be retrieved from said container;

(e) a lid having an upper surface and a lower surface, said lid being removably attached to said container so as to cover the upper open end thereof; and (f) a conduit leading from the lower end of said hollow structure to near the lower end of the container, said conduit terminating in a spigot having an open position and a closed position, such that when said spigot is in its open position, any liquid contents within said hollow structure is tree to flow through said conduit and out of said spigot.

2. The cold can or bottle cooler dispenser of claim 1, wherein the means for shielding and accessing comprises a cowling which surrounds and closely contacts said container, said cowling having an opening or doorway therein, said cowling being capable of being rotated with respect to said container, whereby when said cowling is rotated until said opening or doorway therein is aligned with one of the openings in said side wall, a beverage receptacle may be retrieved therefrom.

3. The cold can or bottle cooler dispenser of claim 2, wherein the lid comprises:

(a) an outer lid having an opening in the center thereof, said opening providing access to the upper open end of the hollow structure, said outer lid covering the upper open ends of the beverage receptacle compartments and the upper open ends of the cooling compartments; and (b) an inner lid covering the upper open end of the hollow structure;

whereby one may remove the inner lid from said container to access the contents of the hollow structure while the outer lid remains in place, or one may remove the outer lid from said container to access the contents of the beverage receptacle compartments and the cooling compartments while the inner lid remains in place.

4. The cold can or bottle cooler dispenser of claim 3, wherein the inner lid is of the press down type and the outer lid is of the screw on type.

5. The cold can or bottle cooler dispenser of claim 1, wherein the lid is a screw-on type lid.

6. The cold can or bottle cooler dispenser of claim 1, wherein the lid is a press-down lid.

7. The cold can or bottle cooler dispenser of claim 1, wherein the lid comprises:

(a) an outer lid having an opening in the center thereof, said opening providing access to the upper open end of the hollow structure, said outer lid covering the upper open ends of the beverage receptacle compartments and the upper open ends of the cooling compartments; and (b) an inner lid covering the upper open end of the hollow structure;

whereby one may remove the inner lid from said container to access the contents of the hollow structure while the outer lid remains in place, or one may remove the outer lid from said container to access the contents of the beverage receptacle compartments and the cooling compartments while the inner lid remains in place.

8. The cold can or bottle cooler dispenser of claim 7, wherein the inner lid is of the press-down type.

9. The cold can or bottle cooler dispenser of claim 7, wherein the outer lid is of the screw-on type.

10. The cold can or bottle cooler dispenser of claim 10, wherein each of said beverage receptacle compartments is of sufficient height to accommodate a plurality of beverage receptacles stacked upon one another.

11. The cold can or bottle cooler dispensers of claim 1, wherein the partitions are bowed so as to conform to the shape of the beverage receptacles.

12. The cold can or bottle cooler dispenser of claim 1, wherein the bottom portion of each beverage receptacle compartment is angled outward with respect to the center of the container, whereby when the means for shielding and accessing is moved to reveal one of the openings in the wall thereof, a beverage receptacle is propelled therefrom.

13. The cold can or bottle cooler dispenser of claim 1, wherein the lid is transparent.

14. The cold can or bottle cooler dispenser of claim 1, wherein the means for shielding and accessing is transparent.

15. The cold can or bottle cooler dispenser of claim 1, wherein each beverage receptacle compartment further comprises a floor at the lower end thereof, said floor angling downward from the portion of said floor closest to the hollow structure to the portion of said floor closest to the opening in said side wall.

16. The cold can or bottle cooler dispenser of claim 1, wherein the means for cooling the beverage receptacles is selected from the group consisting of ice, dry ice, and reusable ice substitute packs.

17. The cold can or bottle cooler dispenser of claim 1, wherein the conduit leading from the lower end of said hollow structure to near the lower end of the container is embedded in the bottom wall of the container.

18. The cold can or bottle cooler dispenser of claim 1, further comprising a handle attached thereto, whereby said dispenser may be easily carried.

19. A cold can or bottle cooler dispenser for providing portable storage for a beverage and beverage receptacles selected from the group consisting of beverage cans and beverage bottles, said dispenser comprising:

(a) a generally cylindrically shaped container with a central axis, said container having;

(i) an upper open end and a lower closed end, said lower closed end having a bottom wall of predetermined thickness; and (ii) a side wall of predetermined height and predetermined thickness, said side wall having an upper end, a lower end, an inner surface, and an outer surface, said side wall and said bottom wall of said container defining an interior region;

(b) a hollow structure for holding a beverage, said hollow structure having the same height as said side wall, said hollow structure having an upper open end and a lower end attached to said bottom wall, said hollow structure being centrally disposed within said interior region of said container and aligned with the central axis of said container, said hollow structure having an inner surface and an outer surface, the region between said container and said hollow structure defining a space;

(c) a plurality of partitions extending from the inner surface of the side wall to the outer surface of the hollow structure, said partitions being attached to said bottom wall and having substantially the same height as said side wall, said partitions dividing the defined space into an alternating series of beverage receptacle compartments for holding beverage receptacles and cooling compartments for holding means for cooling beverage receptacles, each of said beverage receptacle compartments being bounded by a section of the side wall, each of said beverage receptacle compartments having a predetermined height, each of said beverage receptacle compartments being sized to contain therein a beverage receptacle, each of said beverage receptacle compartments having an upper open end for receiving a beverage receptacle, each of said beverage receptacle compartments having an opening in said section of the side wall near the lower end thereof for dispensing a beverage receptacle, each of said cooling compartments having an upper open end;

(d) means for shielding and accessing for covering and accessing the openings in the side wall, said means for shielding and accessing being capable of being moved with respect to said side wall, thus enabling a beverage receptacle to be retrieved from said container;

(e) an outer lid having an opening in the center thereof, said opening providing access to the upper open end of the hollow structure, said outer lid covering the upper open ends of the beverage receptacle compartments and the upper open ends of the cooling compartments;

(f) an inner lid covering the upper open end of the hollow structure;

whereby one may remove the outer lid from said container to access the contents of the hollow structure while the inner lid remains in place, or one may remove the inner lid from said container to access the contents of the beverage receptacle compartments and the cooling compartments while the outer lid remains in place; and (g) a conduit leading from the lower end of said hollow structure to near the lower end of the container, said conduit terminating in a spigot having an open position and a closed position, such that when said spigot is in its open position, any liquid contents within said hollow structure is free to flow through said conduit and out of said spigot.

20. A cold can or bottle cooler dispenser for providing portable storage for a beverage and beverage receptacles selected from the group consisting of beverage cans and beverage bottles, said dispenser comprising:

(a) an outer housing comprising an outer insulating wall of predetermined thickness, said outer insulating wall having an outer surface and an inner surface, said outer insulating wall having an opening in the lower end thereof, said outer insulating wall having a dispensing spigot near a lower edge of the outer surface thereof;

(b) a cylindrical compartment section disposed within and contiguous to the inner wall of the outer housing;

(c) means for shielding and accessing for covering and accessing the opening in the side wall, said means for shielding and accessing being capable of being moved with respect to said side wall, thus enabling a beverage receptacle to be retrieved from said housing;

(d) a lid having an upper surface and a lower surface, said lid being removably attached to said housing so as to cover the upper open end thereof; and (e) a conduit leading from the inside of said housing to the outside of said housing, said conduit terminating in a spigot having an open position and a closed position, such that when said spigot is in its open position, any liquid contents within said housing is free to flow through said conduit and out of said spigot.

* * * * *